United States Patent [19]

Gurries

[11] Patent Number: 4,511,282

[45] Date of Patent: Apr. 16, 1985

[54] PAVEMENT PENETRATING TOOL

[75] Inventor: Raymond A. Gurries, Reno, Nev.

[73] Assignee: Resonant Technology Company, Sparks, Nev.

[21] Appl. No.: 492,922

[22] Filed: May 9, 1983

Related U.S. Application Data

[63] Continuation-in-part of Ser. No. 329,149, Dec. 10, 1981, Pat. No. 4,402,629, which is a continuation-in-part of Ser. No. 157,138, Jun. 5, 1980, Pat. No. 4,340,255.

[51] Int. Cl.[3] ..... E01C 23/12

[52] U.S. Cl. ..... 404/90; 299/37; 173/94

[58] Field of Search ..... 404/90, 133, 91, 124, 404/121; 37/DIG. 18; 299/37, 14, 36; 173/139, 94; 172/40; 241/195, 185 R

[56] References Cited

U.S. PATENT DOCUMENTS

| | | | |
|---|---|---|---|
| 1,070,326 | 8/1913 | Coutant et al. | 404/133 |
| 2,484,289 | 10/1949 | Greiner | 404/124 |
| 3,071,050 | 1/1963 | Shatto | 404/126 |
| 3,276,337 | 10/1966 | Gardner | 404/124 |
| 3,327,598 | 6/1967 | Wayer | 404/133 X |
| 3,759,624 | 9/1973 | Hundey | 404/133 |
| 3,787,135 | 1/1974 | Layton | 404/133 X |
| 3,961,856 | 6/1976 | Degenhart | 404/133 |
| 4,005,944 | 2/1977 | Harris | 404/133 |
| 4,320,807 | 3/1982 | Gurries | 173/49 |
| 4,402,629 | 9/1983 | Gurries | 404/90 |

*Primary Examiner*—James A. Leppink
*Assistant Examiner*—Beverly E. Hjorth
*Attorney, Agent, or Firm*—Townsend & Townsend

[57] ABSTRACT

An improved penetrating tool for pavement breakers is disclosed. The tool of the present invention has a flange with a striking surface which extends in the direction of motion of the vehicle. The striking surface is curved so that the closing angle, defined as the difference between the angle of motion and the angle of inclination of that portion of the striking surface in contact with the pavement, is constant throughout the entire stroke of the tool. The constant closing angle should be within the range of about 6°–18°, preferably about 15°.

7 Claims, 7 Drawing Figures

PAVEMENT PENETRATING TOOL

This application is a continuation-in-part of my copending application entitled "Resonantly Driven Pavement Crusher", Ser. No. 329,149, filed Dec. 10, 1981, now U.S. Pat. No. 4,402,629; which is in turn a continuation-in-part of the patent entitled "Resonantly Driven Vertical Impact System", Ser. No. 157,138 filed June 5, 1980, now U.S. Pat. No. 4,340,255.

BACKGROUND OF THE INVENTION

The present invention relates to pavement breakers in which a cutting or crushing tool is mounted to the output end of a resonantly driven beam, and in particular to the penetration tool used on such devices.

A pavement breaker of the type utilized in connection with the present invention is illustrated in my above-referenced U.S. Pat. No. 4,340,255. The pavement breaker includes a mobile carrier vehicle which rides over the pavement to be broken. A resonant beam having input and output antinodes at its ends and a pair of stationery nodes intermediate its ends is mounted to the vehicle at the nodes. The beam is excited to near its resonant frequency, and a penetrating tool depending from the output end of the beam breaks the pavement underlying the vehicle. The tool may have a relatively narrow striking surface to essentially slice through or cut the underlying pavement, or a wider surface to achieve a pulverizing or crushing action.

The cross-referenced application describes an improvement in the penetrating tool used in the pavement breaker of the type disclosed in the patent. This tool includes a flat bottom surface, and inclined flanges forward and rear. The forward flange strikes the pavement at a relatively small closing angle, between about 6° and 18°, to initially break the pavement. The flat bottom further crushes the pieces broken off by the forward flange. The rear flange is provided so that the tool can be reversed when the flange in use becomes worn.

While the tool described in the cross-referenced application has been found to be quite useful, the required force to break the pavement has been found to increase as the stroke of the tool proceeds toward completion. It has been discovered that this results from the fact that the closing angle, defined as the angle between the direction of motion of the portion of the tool striking the pavement and the inclination of the flange at that point, increases throughout the stroke of the tool. The tool essentially pivots about the adjacent node of the resonant beam, and the increased distance between this node position and the portion of tool striking the pavement increases throughout the stroke of the tool, thus increasing the closing angle.

The system must accommodate the maximum force encountered, which will occur at the end of the stroke in the tool described above. As a result a system with such a tool will operate below its optimum at intermediate portions of the stroke. This system is somewhat unstable because the reaction forces will vary with the depth of penetration of the tool and also with irregularities in the surface being broken.

SUMMARY OF THE INVENTION

The present invention provides an improved penetrating tool for pavement breakers as described in U.S. Pat. No. 4,340,255. The tool of the present invention has a flange with a striking surface which extends in the direction of motion of the vehicle. The striking surface is curved so that the closing angle, defined as the difference between the angle of motion and the angle of inclination of that portion of the striking surface in contact with the pavement, is constant throughout the entire stroke of the tool. The constant closing angle should be within the range of about 6°–18°, preferably about 15°.

By providing a constant closing angle along the striking surface of the tool, the required input force to penetrate the material remains constant, as are the reaction forces on the beam. The system can thus be operated at its near optimum mode at all times, without undue concern about wide excursions in the required input and resultant reaction forces. This results in a far more stable and efficient operation, and because the system operates near optimum at all times, its performance is significantly improved.

The novel features which are characteristic of the invention, as to organization and method of operation, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figure 1:
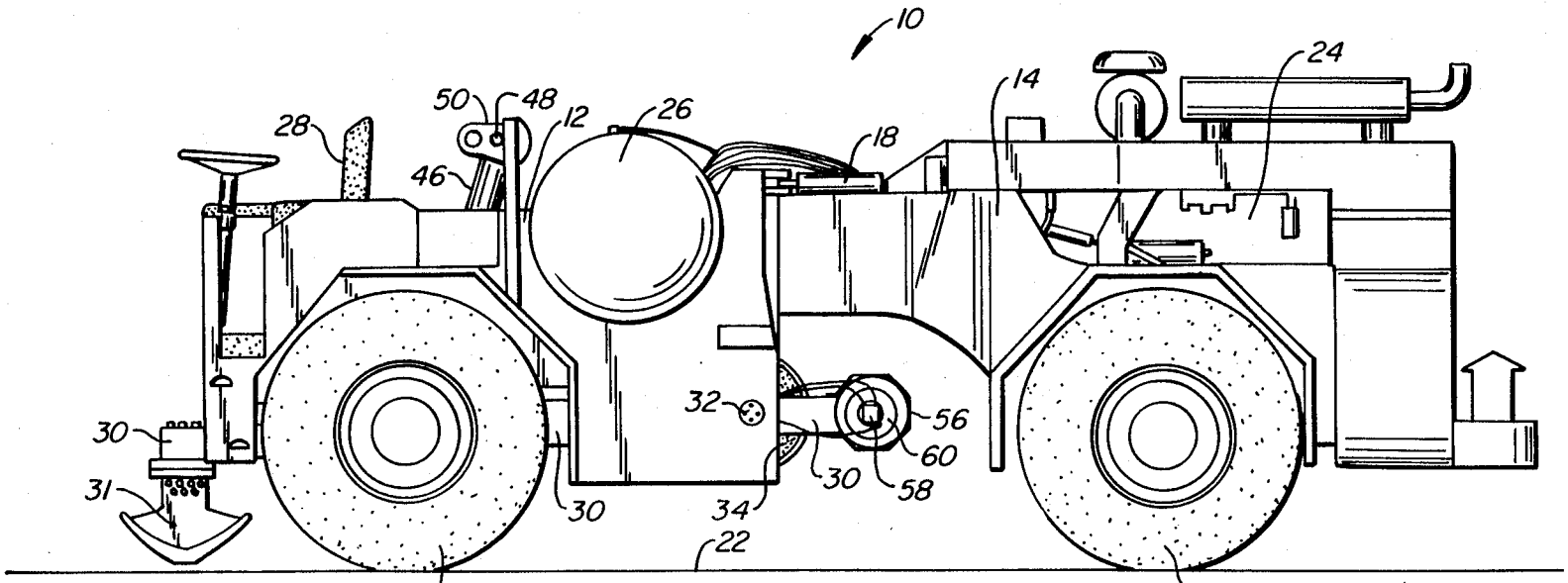
FIG. 1 is an elevation view of a pavement breaker incorporating the tool of the present invention.
Figure 2:
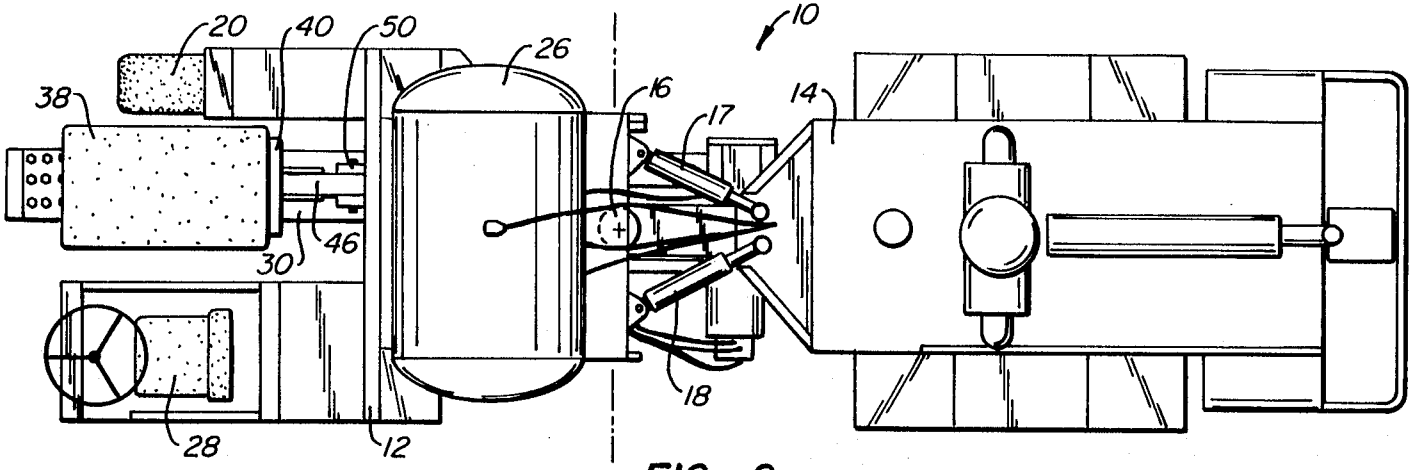
FIG. 2 is a plan view of the embodiment of FIG. 1.

The preferred embodiment 10 of a vertical impact system incorporating the present invention is illustrated generally by way of reference to FIGS. 1 and 2 in combination. Impact system 10 includes a carrier vehicle with a forward frame 12 connected to a rear frame 14 by an articulating joint 16. Hydraulic actuators 17, 18 extend between forward and rear frames 12, 14 to control articulation of the vehicle. The carrier vehicle rides on wheels 20 over a surface 22 which is to receive vertical impact forces for some purpose, such as old pavement to be broken up and removed, existing pavement to be cut for utility work, and the like.

An engine 24 is mounted on rear frame 14, and provides both motive power for the wheels 20 and hydraulic power from a reservoir 26. The operator of the vehicle rides in a control cab 28 projecting forwardly and to one side of the remainder of the vehicle.

A solid, homogeneous resonant beam 30, typically steel, is supported by the carrier vehicle. In the preferred embodiment, resonant beam 30 is approximately 12½ feet long, and has a resonant frequency of about 45 cycles per second when vibrating transversely about forward and aft nodes spaced inwardly from its ends. While resonating in this fashion, resonant beam 30 has antinodes (locations of maximum amplitude) at its opposite ends and approximately at its center. Pavement penetrating tool 31 depends from the forward end of beam 30.

Resonant beam 30 is supported at its aft node by a shaft 32 which projects through the beam at the location of the aft node (see U.S. Pat. No. 4,320,807). Shaft 32 is supported by a pair of pneumatic tires 34 embedded in the forward frame 12 of the vehicle. Since shaft 32 passes through a node position of beam 30, vibration of the beam at the node position is relatively small (theoretically zero) and the transmission of vibratory forces from the beam to the frame is minimized.

A massive weight 38 is superimposed over beam 30 toward its forward end. Weight 38 is fixed to a bracket 40 which is in turn connected to a member (not shown) which pivots about shaft 32 to control the position of the weight relative to beam 30. An hydraulic cylinder 46 depends from a pin 48 attached to a portion 50 of the forward frame 12, and is fixed to bracket 40. Hydraulic cylinder 46 is of the single acting type, in which the cylinder can be contracted to lift weight 38, but cannot be extended to push down on the weight. Use of such a single acting cylinder allows weight 38 to be raised for transportation of the system, but inhibits the transmission of reaction forces from weight 38 to frame element 50 of the vehicle. Beam 30 is attached to the underside of weight 38 at the forward node of the beam, as discussed in more detail hereinafter.

Beam 30 has an enlarged housing formed in its input end 56, in which is located an eccentric oscillator. A hydraulic motor 60 operated by drive 58 rotates the eccentric oscillator to vibrate the beam at at least near its resonant frequency. Tool 31, depending from the output end of resonant beam 30, is thus driven to penetrate underlying surface 22.

Figure 3:
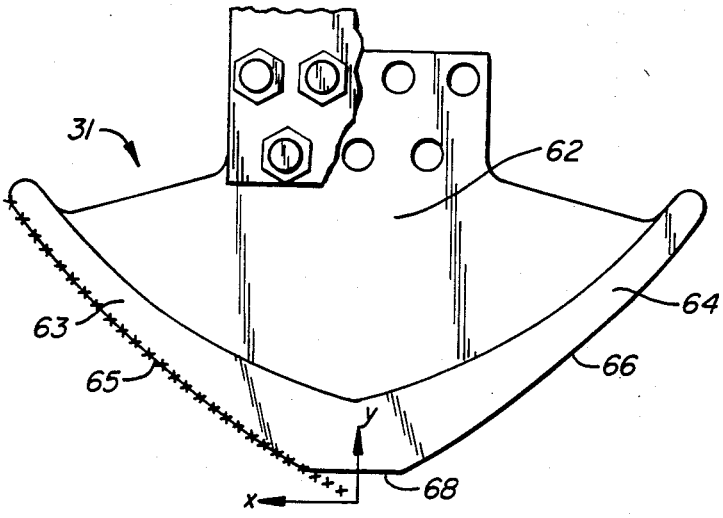
FIG. 3 is an elevation view of the preferred embodiment of the tool of the present invention.
Figure 4:
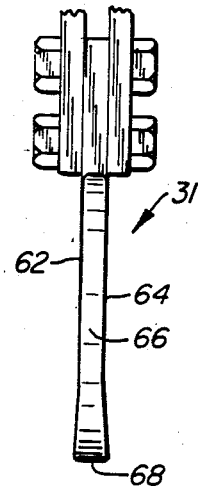
FIG. 4 is a plan view of the embodiment of FIG. 3.

A preferred embodiment of tool 31 is illustrated in more detail by way of reference to FIGS. 3 and 4. Tool 31 includes a shank 62 with forwardly and rearwardly disposed inclined flanges 63, 64. Flanges 63, 64 have mirror image striking surfaces 65, 66 having a complex curved configuration. A flat horizontal surface 68 is located at the base of the tool and is contiguous with striking surfaces 65, 66.

Preferred embodiment 31 of the present invention depicts a cutting type of tool which is quite narrow, having a transverse dimension of about $1\frac{1}{4}''$ at the base and about $\frac{3}{4}''$ along the flanges. This tool will provide a cutting type of action for the underlying surface, but the present invention could also be adapted to wider tools used to achieve a crushing or breaking action.

Figure 5B:
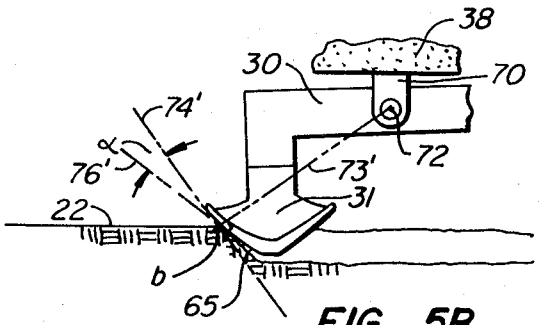
FIGS. 5A and B are schematic views depicting the operation of the preferred embodiment of the tool of the present invention.
Figure 5A:
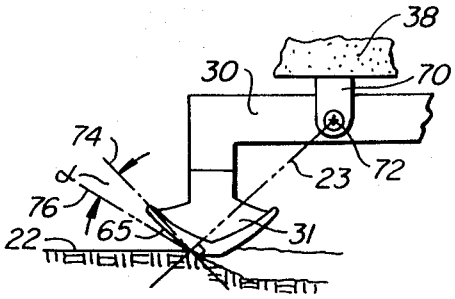

As illustrated in FIGS. 5A and B, resonant beam 30 is attached to weight 38 by a link 70 connected to an abutment 72 emanating from the beam at the location of its forward node. When resonant beam 30 is vibrating, the forward portion of the beam, including tool 31 attached thereto, essentially pivots about the location of its forward node, i.e., abutment 72. (The movement of the beam is actually more complex because it is bending, but this fact is insignificant for the purposes of the present discussion.)

The point "a" of a striking surface 65 of tool 31 in instantaneous contact with surface 22 moves in an essentially circular arc centered at abutment 72. Line 73 on FIG. 5 shows the radius of the arc and line 74 shows a perpendicular thereto. Line 74 is thus a tangent to a circle centered at abutment 72 and passing through point "a", and indicates the direction of motion of point "a".

The degree to which striking surface 65 impacts underlying surface 22 depends on the "closing angle", designated "$\alpha$". The closing angle is the amount by which the angle of inclination of the tool at point "a", represented by a tangent line 76 to surface 65 at point "a", exceeds the direction of motion of the tool as represented by line 74.

Figure 6:
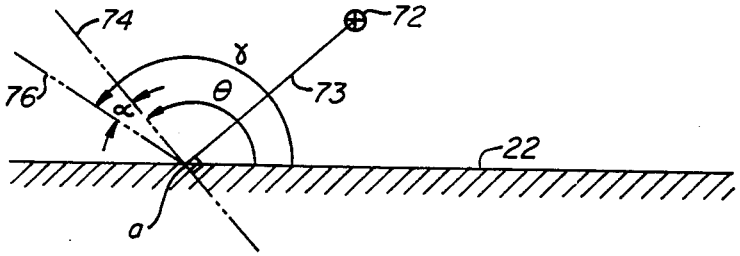
FIG. 6 is a schematic depiction of the angular relationships of the present invention.

Turning to FIG. 6, the angle of motion of the tool, considered an oblique angle from surface 22, is represented by $\theta$. $\theta$ is the angular distance measured about "a" from surface 22 to line 74, the direction of motion of the point "a" of the tool. The angle of inclination of the tool, represented by $\gamma$, is the oblique angle taken about "a" from surface 22 to line 76, 76 being the tangent to striking surface 65 of the tool at point "a". The difference between $\gamma$ and $\theta$ is $\alpha$, the closing angle of the tool.

FIG. 5B shows tool 31 further penetrating surface 22 relative to the position shown in FIG. 5A, and the point at which the striking surface 65 contacts surface 22 has moved to point "b". Comparing FIG. 5B with 5A, it is apparent that as striking surface 65 of tool 31 penetrates surface 22, the distance from node 72 to the point at which striking surface 65 contacts surface 22, as represented by line 73', increases. As a result, $\theta'$ the angle of motion of point "b", is greater than $\theta$. The object of the present invention is to maintain $\alpha$ constant, and since $\theta$ decreases as the point of impact moves outwardly along the tool, $\gamma$, the angle of a tangent to the striking surface of the tool, decreases by the same amount.

Referring to FIG. 3, coordinates X and Y are located at the theoretical base of the tool, determined by the point at which striking surfaces 65, 66 would meet if they were not truncated by flat surface 68. In the embodiment shown, the theoretical base of the tool is located 25 inches forward of and $28\frac{1}{4}$ inches below forward node position 72. The shape of striking surface 65, and mirror image surface 66, is determined by the following table.

| X | Y | X | Y |
|---|---|---|---|
| 0 | 0 | 8 | 5 5/16 |
| $\frac{1}{2}$ | 7/32 | $8\frac{1}{2}$ | $5\frac{3}{4}$ |
| 1 | 15/32 | 9 | 6 3/16 |
| $1\frac{1}{2}$ | 23/32 | $9\frac{1}{2}$ | $6\frac{5}{8}$ |
| 2 | 1 | 10 | $7\frac{1}{8}$ |
| $2\frac{1}{2}$ | 1 5/16 | $10\frac{1}{2}$ | $7\frac{5}{8}$ |
| 3 | $1\frac{5}{8}$ | 11 | $8\frac{1}{8}$ |
| $3\frac{1}{2}$ | 1 29/32 | $11\frac{1}{2}$ | 8 23/32 |
| 4 | $2\frac{1}{4}$ | 12 | $9\frac{1}{4}$ |
| $4\frac{1}{2}$ | 2 9/16 | $12\frac{1}{2}$ | 9 25/32 |
| 5 | $2\frac{7}{8}$ | 13 | $10\frac{3}{8}$ |
| $5\frac{1}{2}$ | 3 9/32 | $13\frac{1}{2}$ | 11 1/32 |
| 6 | 3 21/32 | | |
| $6\frac{1}{2}$ | 4 1/16 | | |
| 7 | 4 15/32 | | |
| $7\frac{1}{2}$ | $4\frac{7}{8}$ | | |

In operation, tool 31 of the present invention penetrates surface 22 at a closing angle $\alpha$. The striking surface 65 of tool 31 is curved so that as the tool penetrates the surface, the closing angle remains constant because of the curvature of the striking tool. As a result, the force required to cut through the surface, and the reaction forces on the beam absorbed by weight 38, are essentially constant.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

I claim:

1. In a pavement breaker including a mobile vehicle adapted to ride over the surface to be penetrated, a resonant beam having input and output antinodes at input and output ends respectively and at least one node between the ends of the beam at which the beam is mounted to the vehicle, and means for vibrating the resonant beam at at least near its resonant frequency, an improved tool depending from the output end of the beam comprising a flange with a striking surface extending in the operative direction of motion of the vehicle and having a shape which is curved so that the angle between the direction of motion of the striking surface at the point of contact with the surface to be penetrated and the tangent to the striking surface at the point of contact with the surface to be penetrated is constant throughout the stroke of the tool.

2. The pavement breaker of claim 1 in which the angle difference is within a range of about 6° to 18°.

3. The pavement breaker of claim 2 in which the angle difference is substantially 15°.

4. The pavement breaker of claim 1 wherein the tool includes a flat horizontal surface at the base of the tool contiguous with the striking surface.

5. The pavement breaker of claim 1 and additionally comprising a second striking surface projecting in a direction opposite from the operative direction of motion of the vehicle, said second striking surface having a configuration identical to that of the first striking surface so that the tool can be inverted for use of the second striking surface when the first striking surface has become worn.

6. The pavement breaker of claim 5 wherein the tool includes a flat horizontal surface at the base of the tool contiguous to the first and second striking surfaces.

7. The pavement breaker of claim 1 wherein the width of the striking surface is between about $\frac{3}{4}''$ and $1\frac{1}{4}''$.

* * * * *